US006036563A

United States Patent [19]

Walker

[11] Patent Number: 6,036,563

[45] Date of Patent: Mar. 14, 2000

[54] CHAIR FLOATATION DEVICE

[76] Inventor: Willette Walker, 1104 Davis Dr., Tampa, Fla. 33619

[21] Appl. No.: 09/090,142

[22] Filed: Jun. 4, 1998

[51] Int. Cl.[7] ..... B63C 9/08

[52] U.S. Cl. ..... 441/130; 441/126

[58] Field of Search ..... 441/126, 127, 441/129, 130, 131, 132; 297/250.1

[56] References Cited

U.S. PATENT DOCUMENTS 4,711,490 12/1987 Brand ..... 297/250.1
4,725,253 2/1988 Politte ..... 441/130
4,927,397 5/1990 Yeager ..... 441/41
5,711,574 1/1998 Barnes ..... 297/250.1

*Primary Examiner*—Sherman Basinger

[57] ABSTRACT

A new chair floatation device for permitting a person, such as a child, to float comfortably in a body of water. The inventive device includes a hollow body member with a back wall portion forming a backrest, a seat portion, and a front wall portion. A pair of spaced apart leg holes extend through the front wall portion. A tray extends from the front wall and a pair of spaced apart armrests extend between the back wall portion and the front wall portion. A seat harness member 50 extends between the front wall portion 32 and the back wall portion 26 while a belt strap harness 60 is also coupled to the body member.

20 Claims, 2 Drawing Sheets

CHAIR FLOATATION DEVICE

BACKGROUND OF THE INVENTION

1. Field of the Invention

The present invention relates to floatation devices and more particularly pertains to a new chair floatation device for permitting a person, such as a child, to float comfortably in a body of water.

2. Description of the Prior Art

The use of floatation devices is known in the prior art. More specifically, floatation devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art floatation devices include U.S. Pat. No. 5,439,405; U.S. Pat. No. 4,799,910; U.S. Pat. No. Des. 280123; U.S. Pat. No. 3,860,976; U.S. Pat. No. 5,219,309; and U.S. Pat. No. 5,122,086.

While these devices fulfill their respective, particular objectives and requirements, the aforementioned patents do not disclose a new chair floatation device. The inventive device includes a hollow body member with a back wall portion forming a backrest, a seat portion, and a front wall portion. A pair of spaced apart leg holes extend through the front wall portion. A tray extends from the front wall and a pair of spaced apart armrests extend between the back wall portion and the front wall portion. A seat harness member 50 extends between the front wall portion 32 and the back wall portion 26 while a belt strap harness 60 is also coupled to the body member.

In these respects, the chair floatation device according to the present invention substantially departs from the conventional concepts and designs of the prior art, and in so doing provides an apparatus primarily developed for the purpose of permitting a person, such as a child, to float comfortably in a body of water.

SUMMARY OF THE INVENTION

In view of the foregoing disadvantages inherent in the known types of floatation devices now present in the prior art, the present invention provides a new chair floatation device construction wherein the same can be utilized for permitting a person, such as a child, to float comfortably in a body of water.

The general purpose of the present invention, which will be described subsequently in greater detail, is to provide a new chair floatation device apparatus and method which has many of the advantages of the floatation devices mentioned heretofore and many novel features that result in a new chair floatation device which is not anticipated, rendered obvious, suggested, or even implied by any of the prior art floatation devices, either alone or in any combination thereof.

To attain this, the present invention generally comprises a hollow body member with a back wall portion forming a backrest, a seat portion, and a front wall portion. A pair of spaced apart leg holes extend through the front wall portion. A tray extends from the front wall and a pair of spaced apart armrests extend between the back wall portion and the front wall portion. A seat harness member 50 extends between the front wall portion 32 and the back wall portion 26 while a belt strap harness 60 is also coupled to the body member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new chair floatation device apparatus and method which has many of the advantages of the floatation devices mentioned heretofore and many novel features that result in a new chair floatation device which is not anticipated, rendered obvious, suggested, or even implied by any of the prior art floatation devices, either alone or in any combination thereof.

It is another object of the present invention to provide a new chair floatation device which may be easily and efficiently manufactured and marketed.

It is a further object of the present invention to provide a new chair floatation device which is of a durable and reliable construction.

An even further object of the present invention is to provide a new chair floatation device which is susceptible of a low cost of manufacture with regard to both materials and labor, and which accordingly is then susceptible of low prices of sale to the consuming public, thereby making such chair floatation device economically available to the buying public.

Still yet another object of the present invention is to provide a new chair floatation device which provides in the apparatuses and methods of the prior art some of the advantages thereof, while simultaneously overcoming some of the disadvantages normally associated therewith.

Still another object of the present invention is to provide a new chair floatation device for permitting a person, such as a child, to float comfortably in a body of water.

Yet another object of the present invention is to provide a new chair floatation device which includes a hollow body member with a back wall portion forming a backrest, a seat portion, and a front wall portion. A pair of spaced apart leg holes extend through the front wall portion. A tray extends from the front wall and a pair of spaced apart armrests extend between the back wall portion and the front wall portion. A seat harness member 50 extends between the front wall portion 32 and the back wall portion 26 while a belt strap harness 60 is also coupled to the body member.

Still yet another object of the present invention is to provide a new chair floatation device that allows a second person, such as an adult, to be attached to the invention to permit that person to tow a person in the chair floatation device.

Even still another object of the present invention is to provide a new chair floatation device that allows children the enjoyment floating in deep water.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
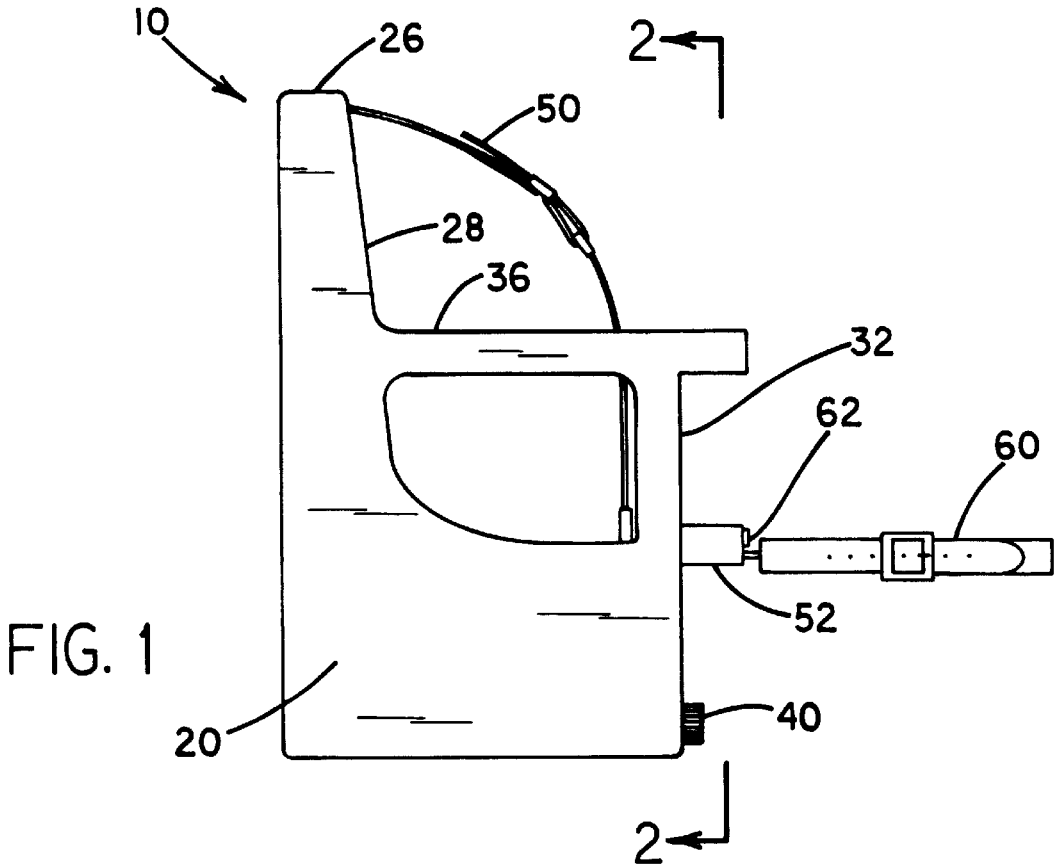
FIG. 1 is a side view of a new chair floatation device according to the present invention.

With reference now to the drawings, and in particular to FIGS. 1 through 4 thereof, a new chair floatation device embodying the principles and concepts of the present invention and generally designated by the reference numeral 10 will be described.

As best illustrated in FIGS. 1 through 4, the chair floatation device 10 generally comprises a hollow body member 20 with a back wall portion 26 forming a backrest 28, a seat portion 30, and a front wall portion 32. A pair of spaced apart leg holes 34 extend through the front wall portion 32. A seat harness member 50 extends between the front wall portion 32 and the back wall portion 26 while a belt strap harness 60 is also coupled to the body member.

The seat portion 30 is preferably located between the front wall portion 32 and the back wall portion 26 so that the torso of a person sitting on the seat portion 30 is positioned between the two wall portions. The leg holes 34 allow a person sitting on the seat portion 30 to extend their legs through the front wall portion 32 for achieving a comfortable sitting position and to help provide additional stability in keeping the invention upright when floating in a body of water.

The seat harness member 50 is designed for helping hold a person sitting on the seat portion 30 to the body member 20. The seat harness member 50 may be any suitable harness system known in the art. Preferably, the seat harness member 50 is coupled to the back wall portion 26 and the seat portion 30. Ideally, the seat harness member 50 is a Y-shaped strap harness system that is detachably attached to the front wall portion 32. Its is also preferable that the seat harness member 50 includes adjustable shoulder straps to aid proper holding of a person to the body member 20.

The belt strap harness 60 is designed for attachment around the torso of a person. Preferably, the belt strap harness 60 is detachably attached to a support shaft 52 extending from the body member front wall portion 32 so that a person attached to the body member 20 by the belt strap harness may face the front wall portion 32. The support shaft helps to keep the body portion 20 stable in a body of water when the belt strap harness is attached to the torso of a person. Ideally, the belt strap harness includes a quick type release means 62 for permitting quick detachment of the belt strap harness 60 from the body member 20

The hollow interior 22 of the body member 20 is designed to permit floatation of the chair floatation device 10 when the invention is placed in water. Preferably, the hollow interior 22 is designed to permit floatation of the chair floatation device 10 when a person is sitting on the seat portion 30. The hollow interior 22 of the body member is also designed so that a ballast material 12 may be provided within the hollow interior 22.

Preferably, the hollow interior 22 is divided into a upper chamber 23 and a lower chamber 24 positioned towards the bottom of the body member 20. The lower chamber 24 is designed to hold ballast material 12 therein. The ballast material 12 may be any material, such as sand or water, suitable for adding weight to the interior 22 of the body member. Together, the lower chamber 24 with ballast material 12 and the upper chamber 23 help maintain the body member 20 in an upright orientation when the invention 10 is placed in a body of water.

Figure 2:
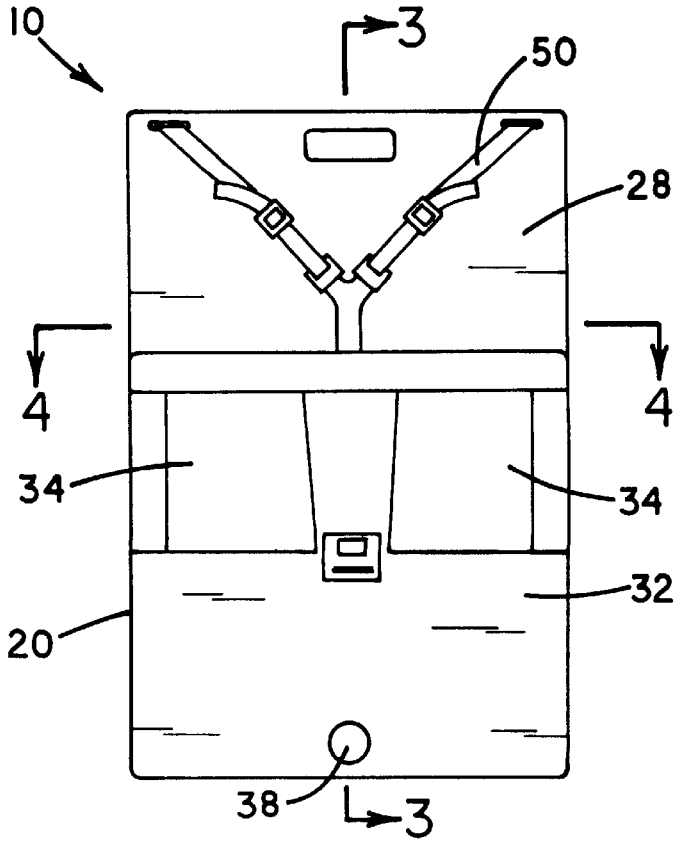
FIG. 2 is another side view of the present invention showing the leg holes as seen from line 2—2 of FIG. 1.
Figure 3:
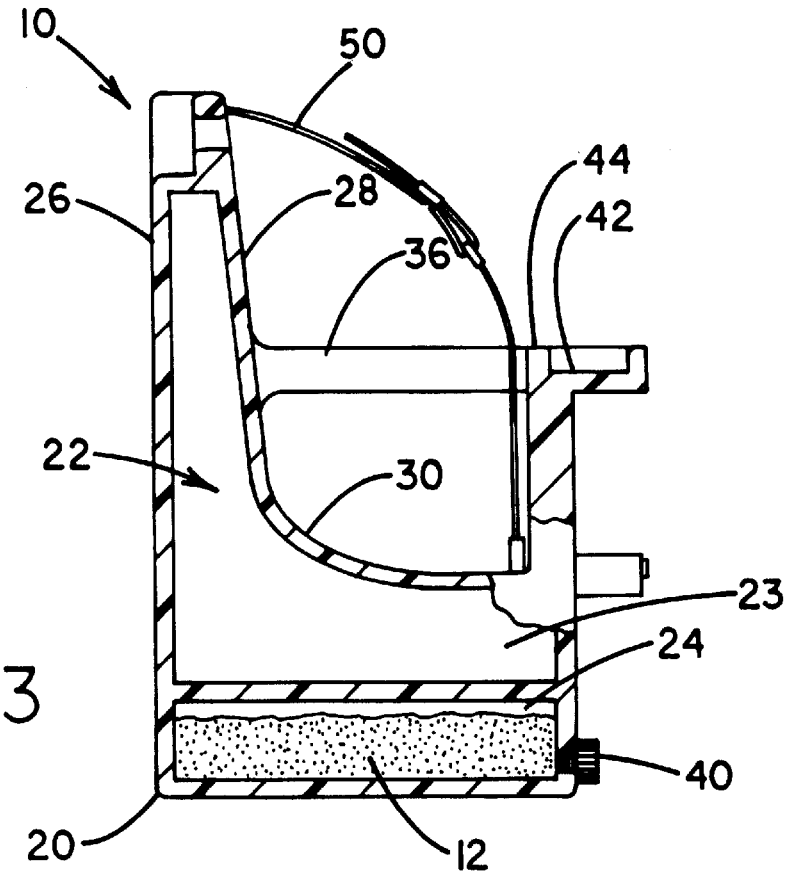
FIG. 3 is a cross sectional view taken from line 3—3 of FIG. 2 of the present invention showing the upper chamber and lower chamber.
Figure 4:
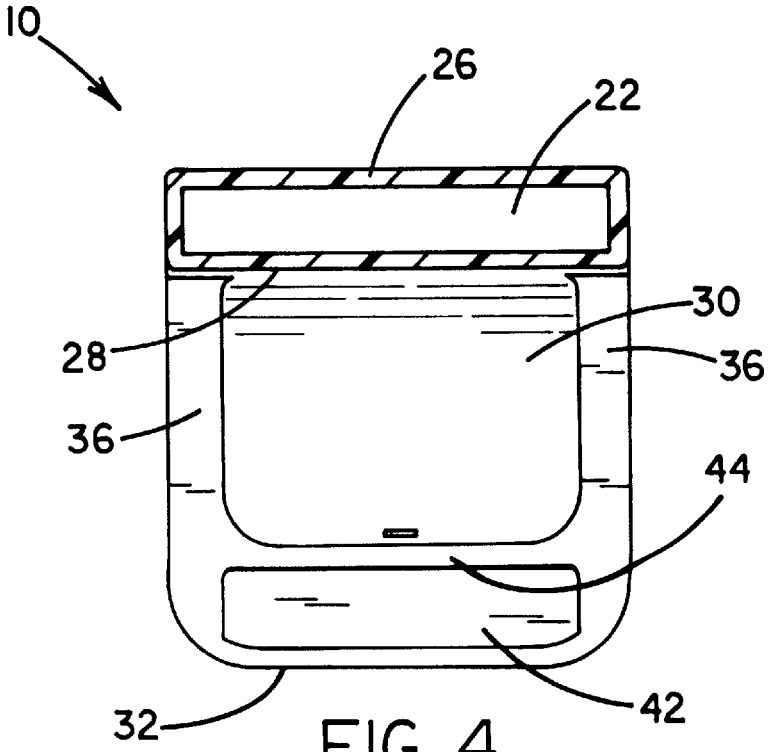
FIG. 4 is a cross sectional view taken from line 4—4 of FIG. 2.

In a preferred embodiment, the body member 20 includes an aperture 38 into the hollow interior 22 to permit the filling and emptying of the hollow interior 22. Ideally, the aperture opens into the lower chamber 24 of the hollow interior. While the aperture 38 may be located anywhere on the body member 20, as shown in FIG. 2, it is preferred that the aperture be located on the front wall portion 32 of the body member 20 for easy access.

The chair floatation device 10 may also include a closure for closing the aperture 38 to permit controlling of the amount of ballast material contained within the lower chamber 24. Preferably the closure is a removable cap 40 removably coupled to the body member 20.

The invention 10 may also included a pair of spaced apart armrest portions 36 between the back wall portion 26 and the front wall portion 32 for providing additional comfort to a person sitting on the seat portion 30.

Preferably, the chair floatation device includes a tray portion 42 extending from the front wall portion 32 for resting items thereon. Ideally, the tray portion 42 includes a retaining wall 44 around its perimeter to help keep items resting on the tray portion 42.

In use, a person is seated on the seat portion 30 with their legs being extended through the leg holes 34 through the front wall 32. The person is then secured to the body member by the seat harness member 50. A second person may then be attached to the invention by the belt strap harness 60. The chair floatation device 10 may then be placed in a body of water. Optionally, once the chair floatation device 10 is placed in the body of water, the aperture 38 may be opened to permit the flow of ballast material either in or out of the lower chamber 24 to permit adjustment of the orientation of the invention in the water.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A chair flotation device, comprising:

a body member having a hollow interior, a front wall portion, a back wall portion, and a seat portion;

a backrest being formed by said back wall portion;

a pair of spaced apart leg holes being extended through said front wall portion;

a seat harness member being extended between said front wall portion and said back wall portion, said seat harness member being for helping hold a person to said body member; and a belt strap harness being coupled to said body member;

wherein a ballast material is provided in said body member hollow interior.

2. The chair flotation device of claim 1, further comprising a pair of spaced apart armrest portions, each of said armrest portions being extended between said front wall portion and said back wall portion.

3. The chair floatation device of claim 1, wherein said seat portion is located between said front wall portion and said back wall portion.

4. The chair floatation device of claim 1, further comprising a tray portion being extended from said front wall portion.

5. The chair floatation device of claim 1, wherein said belt strap harness is detachably attached to said body member.

6. The chair flotation device of claim 5, wherein said body portion includes a support shaft extending from said front wall portion, and wherein said belt strap harness is detachable attached to said support shaft.

7. A chair floatation device, comprising:

a body member having a hollow interior, a front wall portion, a back wall portion, and a seat portion;

a backrest being formed by said back wall portion;

a pair of spaced apart leg holes being extended through said front wall portion;

a seat harness member being extended between said front wall portion and said back wall portion, said seat harness member being for helping hold a person to said body member; and a belt strap harness being coupled to said body member;

wherein said body member hollow interior is divided into a upper chamber and a lower chamber.

8. The chair floatation device of claim 7, wherein a ballast material is provided within said body member hollow interior.

9. The chair floatation device of claim 7, wherein said body member has a bottom, and wherein said lower chamber is positioned towards said body member bottom.

10. The chair floatation device of claim 7, further comprising a ballast material positioned within said lower chamber.

11. The chair floatation device of claim 7, wherein said body member has an aperture into said lower chamber.

12. The chair floatation device of claim 11, wherein said aperture is located in said front wall portion of said body member.

13. The chair floatation device of claim 1, wherein said body member has an aperture into said hollow interior.

14. The chair floatation device of claim 13, further comprising a closure for closing said aperture.

15. The chair floatation device of claim 14, wherein said closure is a removable cap, said removable cap being removably coupled to said body member.

16. A chair flotation device, comprising:

a body member having a hollow interior, a bottom, a front wall portion, a back wall portion, and a seat portion, said seat portion being located between said front wall portion and said back wall portion;

a backrest being formed by said back wall portion;

a pair of spaced apart leg holes being extended through said front wall portion;

a pair of spaced apart armrest portions, each said armrest portions being extended between said front wall portion and said back wall portion;

a tray portion being extended from said front wall portion;

said body member hollow interior being divided into a upper chamber and a lower chamber, said lower chamber being positioned towards said body member bottom;

said front wall portion having an aperture into said lower chamber;

a removable cap being removably coupled to front wall portion, said aperture being closable by said removable cap;

a seat harness member being extended between said seat portion and said back wall portion, said seat harness member being for helping hold a person to said body member;

a support shaft being extended from said front wall portion a belt strap harness being detachably attached to said support shaft; and said lower chamber having a ballast material provided therein.

17. The chair flotation device of claim 7, further comprising a pair of spaced apart armrest portions, each of said armrest portions being extended between said front wall portion and said back wall portion.

18. The chair floatation device of claim 7, wherein said seat portion is located between said front wall portion and said back wall portion.

19. The chair floatation device of claim 7, further comprising a tray portion being extended from said front wall portion.

20. The chair floatation device of claim 7, wherein said belt strap harness is detachably attached to said body member, and wherein said body portion includes a support shaft extending from said front wall portion, and wherein said belt strap harness is detachable attached to said support shaft.

* * * * *